US005295420A

United States Patent [19]

Grimes

[11] Patent Number: 5,295,420

[45] Date of Patent: Mar. 22, 1994

[54] MULTI-PURPOSE OPENER

[76] Inventor: James C. Grimes, Box 9, Lowland, N.C. 28552

[21] Appl. No.: 42,710

[22] Filed: Apr. 5, 1993

[51] Int. Cl.[5] ..... B67B 7/14

[52] U.S. Cl. ..... 81/3.43; 81/64

[58] Field of Search ..... 81/3.43, 3.44, 64; 294/31.2

[56] References Cited

U.S. PATENT DOCUMENTS

| | | | |
|---|---|---|---|
| 970,365 | 9/1910 | Bain | 81/3.43 |
| 1,170,928 | 2/1916 | Nelson | 81/3.43 |
| 1,217,565 | 2/1917 | Catlin | 81/3.43 |
| 1,266,510 | 5/1918 | McMeekin | 81/3.43 |
| 1,310,232 | 7/1919 | Albaum | 81/3.43 |
| 1,414,014 | 4/1922 | Genett | 81/3.43 |
| 1,448,064 | 3/1923 | Hammann | 81/3.43 |
| 3,084,573 | 4/1963 | Lipski | 81/3.43 |

*Primary Examiner*—Robert C. Watson

*Attorney, Agent, or Firm*—Norman B. Rainer

[57] ABSTRACT

A plier-like device for gripping and turning closure caps of jars and bottles has two pivotably interengaged levers that control a compliant inelastic strap forming a loop forwardly of the device. The size of the loop is adjusted to the size of the cap by a spool located in one of the levers and upon which excess length of the strap can be spirally wound. Undesired rotation of the spool is prevented by a ratchet mechanism.

1 Claim, 2 Drawing Sheets

MULTI-PURPOSE OPENER

BACKGROUND OF THE INVENTION

1. Field of the Invention

This invention relates to rotatable closure removal devices and more particularly concerns an adjustable strap device adapted to embrace and rotate threaded closure caps of bottles and jars.

2. Description of the Prior Art

Numerous bottle and jar cap removing devices have been disclosed in the prior art. Various jaw-type and strap-type tools have been employed to remove threadably engaged caps which are tightly fitted to containers. It is desirable that the tool be capable of operation with one hand, easily and untiringly. In such manner of use, widely separated cap-engaging members are brought together to interact with threaded parts of various sizes, leaving the operator's other hand free to grasp the articles on which the threaded parts are affixed. Many earlier disclosed household tools for removing threaded caps are comprised of a multitude of moving parts and are not amenable to low cost manufacture, simple operation, or easy cleanup in the kitchen environment.

For example, U.S. Pat. No. 3,822,614 to Kovacevic discloses a tool having opposed jaws and a lever-actuated mechanism for drawing the jaws together to fit against threaded parts of various sizes. The lever-actuated mechanism comprises a pivotally mounted lever and force-transmitting means movable over an arcuate path in substantially parallel relation to a sliding member formed with a series of rachet teeth. This device has a complex mechanism comprised of many moving parts and is susceptible to contamination with food substances.

Other jar cap removing devices have been disclosed which utilize a compliant strap or band to engage the threaded cap. Typical limitations in these devices have been adjustability, gripping strength, and simplicity of use. A device of this type is disclosed in U.S. Pat. No. 3,964,115 to Platek. This device includes a base having an arcuate serrated member for engaging a portion of a jar cap. A flexible friction-type member such as a strap or the like is adjustably arranged with the base and a spring biased handle. Operation of the handle, as by squeezing, tightens the strap around the cap, whereupon a gripping action is provided by the strap and the arcuate serrated member so that an operator-exerted torquing or twisting action can rotate the cap. This device is capable of producing only a limited amount of gripping force upon the cap.

U.S. Pat. No. 5,056,383 to Halpin discloses a device having a handle provided at one extremity with a unitary cap-gripping member consisting of a generally circular spring-like band having a free extremity. The diameter of the band can accordingly be varied somewhat to accommodate slightly differing cap sizes. The inner surface of the band is provided with projections to grip the cap. This device is only adaptable to caps which vary little in size. Furthermore, the device is capable of exerting only a small amount of gripping force.

It is therefore an object of the present invention to provide a device adapted to grip a threaded closure cap and provide sufficient manually applied torque to loosen or tighten the cap.

It is another object of the present invention to provide a gripping device of the aforesaid nature which may be easily employed with one hand.

It is a further object of this invention to provide a gripping device of the aforesaid nature which may be easily adjusted to fit a wide range of bottle and jar cap sizes and shapes.

It is yet another object of this invention to provide a gripping device of the aforesaid nature having few moving parts and not susceptible to malfunction by foreign substances.

It is still another object of this invention to provide a gripping device of the aforesaid nature which is durable and amenable to low cost manufacture.

These and other beneficial objects and advantages will be apparent from the following description.

SUMMARY OF THE INVENTION

The above and other beneficial objects and advantages are accomplished in accordance with the present invention by a cap gripping device comprised of:

a) first and second levers, each elongated between a handle extremity and opposed head extremity and having pivotal attaching means adjacent said head extremity, said levers joined at said pivotal attaching means in plier-like configuration, permitting coplanar movement of said levers in opposite directions about a center line of symmetry, b) a first jaw block associated with the head extremity of said first lever and elongated between inwardly directed and outwardly directed extremities, a first interior passage directed between said extremities, and an anchoring feature associated with said outwardly directed extremity, c) a second jaw block associated with the head extremity of said second lever and elongated between forward and rear extremities, and a second interior passage directed between said extremities, said forward extremity facing the inwardly directed extremity of said first jaw block, d) a compliant inelastic cap-engaging strap having a fixed extremity secured by said anchoring feature and an adjustable extremity adapted to travel longitudinally within the passage of said second jaw block, said strap forming a loop of adjustable size disposed forwardly of said jaw blocks, e) adjustable, releasable strap retaining means associated with the rear extremity of said second jaw block and adapted to permit unidirectional motion of said strap through said second passage in the direction of said rear extremity, thereby controlling the size of said loop, whereby, when the size of the loop is adjusted to make a close fit upon a particular cap, the lever handle extremities may be manually drawn together to cause said strap to tightly embrace said cap, and rotational force may be manually exerted upon the handle extremities, thereby loosening or tightening said cap.

In a preferred embodiment, the adjustable, releasable strap retaining means is in the form of a flanged spool having a racheted wheel associated with one flange, and a releasable pawl engaging the rachet wheel. A knob may be associated with the spool which may be turned in one direction only to effect shortening of the loop. Means for releasing the pawl permit the strap to be pulled to lengthen the loop. Alternatively, a ratchet engaging mechanism may extend between the rachet wheel and the handle means in a manner to effect rotation of the spool automatically by drawing together the handle extremities.

In alternative embodiments, the strap adjusting means may be in the form of a spring loaded buckle, paired D-rings, spring loaded pivoting clamping jaws, Velcro closure means, eccentric cams, or other mechanical means for permitting unidirectional longitudinal movement of the strap.

In a preferred embodiment, the strap is in the form of a woven fabric webbing such as nylon or cotton. In alternative embodiments, the strap may be in the form of a metal or plastic band, or chain.

The handles may be equipped with releasable locking means which maintain gripping force upon the cap until manually released.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
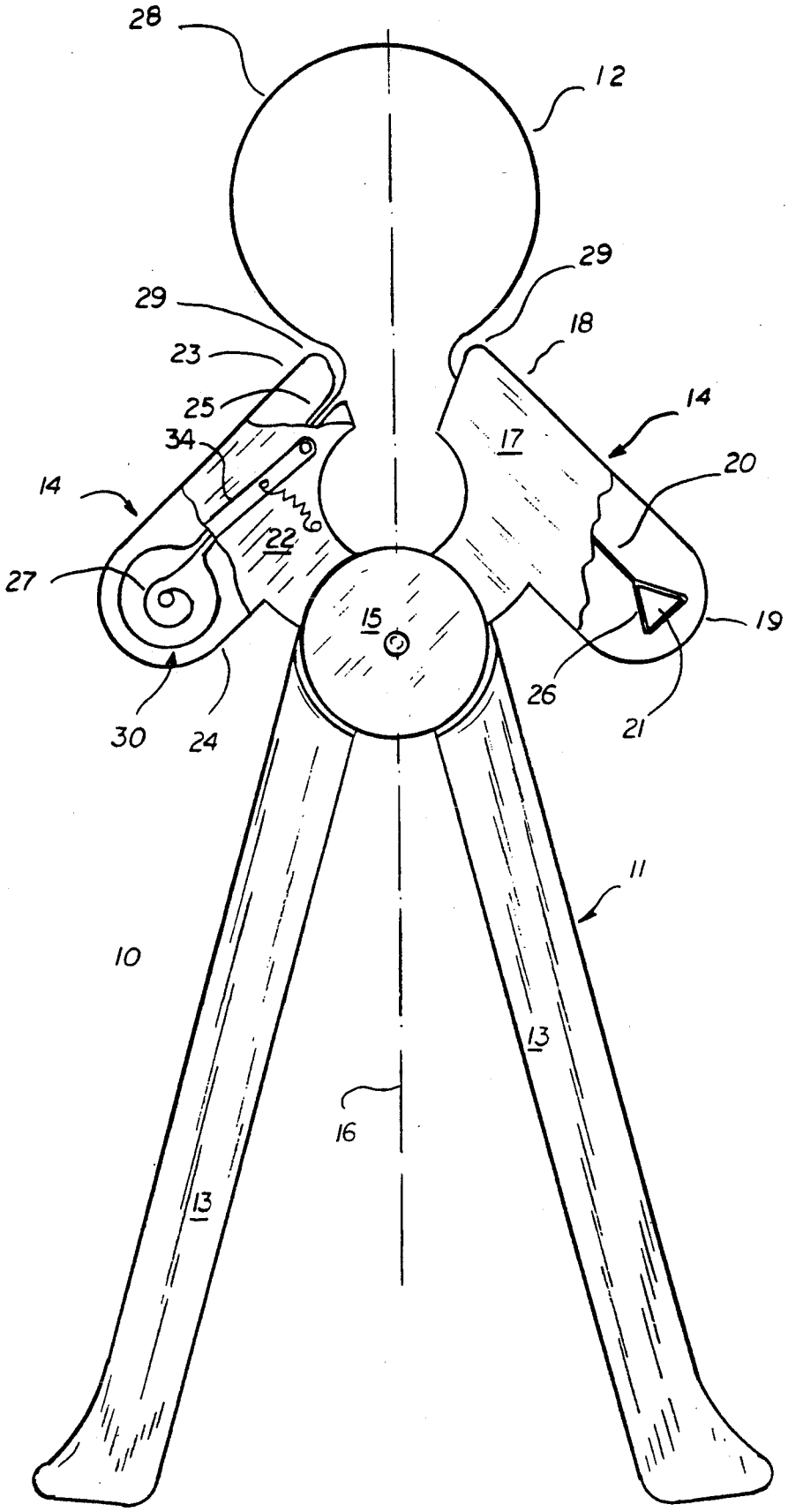
FIG. 1 is a top plan view of an embodiment of the cap gripping means of the present invention with portions broken away.
Figure 2:
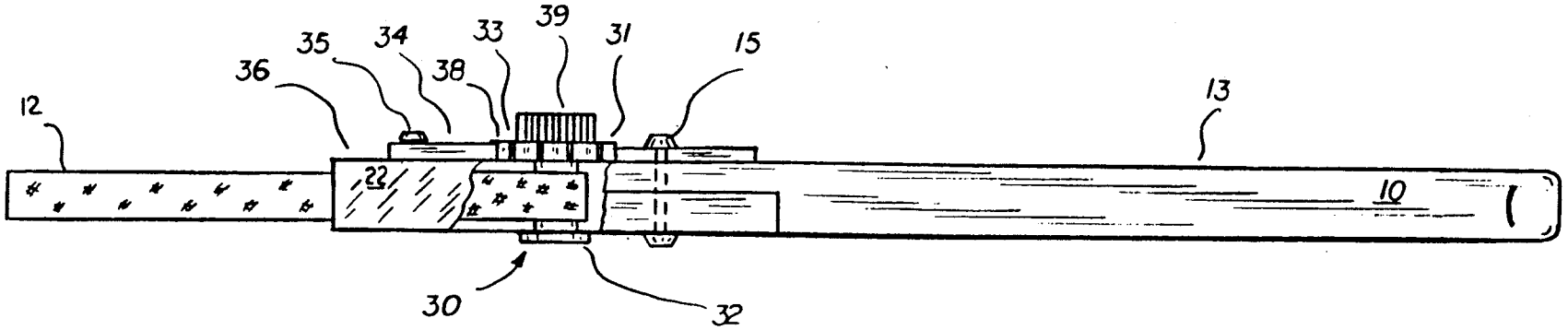
FIG. 2 is a side view of the embodiment of FIG. 1 with portions broken away, taken from the left of FIG. 1.
Figure 3:
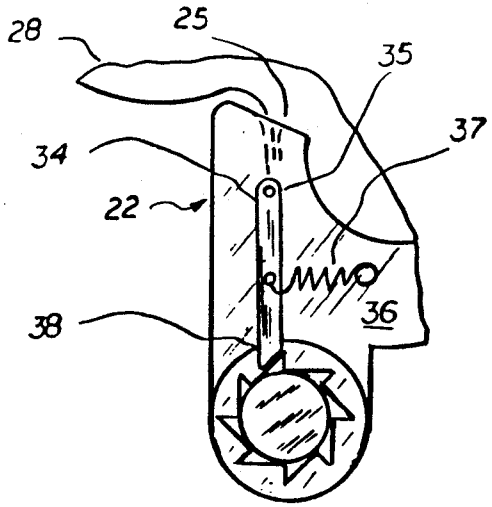
FIG. 3 is an enlarged fragmentary top view with portions broken away.

Referring to FIGS. 1-3, an embodiment of the cap gripping device of the present invention is shown comprised of first and second levers 10 and 11, respectively, and strap 12 disposed forwardly of said levers.

The levers of the illustrated embodiment are of substantially monolithic construction, elongated between a handle extremity 13 and opposed head extremity 14. Pivotal attaching means 15 are located in each lever adjacent said head extremity and the levers are joined in crossing relationship at said attaching means in plier-like configuration, permitting coplanar movement of said levers in opposite directions about a center line of symmetry 16.

A first jaw block 17, associated with the head extremity of said first lever, is elongated between inwardly directed extremity 18 and outwardly directed extremity 19. A first interior passage 20 extends between said extremity 18 and 19, opening upon extremity 18. Anchoring means in the form of wedge 21 is disposed within jaw block 17 adjacent extremity 19 and in communication with passage 20.

A second jaw block 22, associated with the head extremity of said second lever, is elongated between forward and rear extremities, 23 and 24, respectively. A second interior passage 25 extends between said extremities, opening upon forward extremity 23. Said forward extremity faces the inwardly directed extremity 18 of first jaw block 17 in equidistant separation about the line of symmetry, said separation diminishing as the handle portions are forced together.

Strap 12, fabricated of compliant flat inelastic material, has a fixed extremity 26 secured by anchoring wedge 21, and an adjustable extremity 27 attached to take-up spool 30 positioned within rear extremity 24 of jaw block 22. Portions of the strip are disposed within said first and second passages, shown to be shaped so as to closely accommodate the strap. The portion of the strap forwardly emergent from both passages forms a loop 28 of adjustable size disposed in coplanar relationship with said levers. The base of the loop abuts against facing tensioning tips 29 fashioned as portions of said jaw blocks.

The exemplified embodiment of spool 30 is provided with upper and lower flanges 31 and 32, respectively which facilitate securement of the spool to jaw block 22. Upper flange 31 is fashioned as a ratchet wheel containing a multiplicity of unidirectionally oriented teeth 33. A pawl 34 having a distal extremity 38 is attached by pivot pin 35 to the upper surface 36 of jaw block 22. A coil spring 37 interactive between pawl 34 and upper surface 36 urges said distal extremity into engagement with upper flange 31. A knurled knob 39 affixed to spool 30 in coaxial alignment therewith extends above upper surface 36. Said knob enables the user to manually rotate the spool in the direction permitted by pawl 34. Such rotation causes the strap to wind spirally upon the spool, thereby diminishing the size of loop 28. When it is desired to enlarge the loop, pawl 34 is pushed out of engagement with upper flange 31, and the strap is pulled forwardly. In any loop size, the strap is locked by virtue of the interaction of pawl 34 with said upper flange.

In operation, a loop size is selected to fit around a cap or other member to which it is desired to apply torque. The handle extremities are then squeezed together, causing the strap to tightly engage the cap. Turning force can then be applied in either direction by pushing the handles simultaneously in the appropriate direction.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A cap gripping device comprised of:

a) first and second levers, each elongated between a handle extremity and opposed head extremity and interengaged adjacent said head extremity by pivotal attaching means in plier-like configuration, permitting coplanar movement of said levers in opposite directions about a center line of symmetry, b) a first jaw block associated with the head extremity of said first lever and elongated between inwardly directed and outwardly directed extremities, a first interior passage directed between said extremities, and an anchoring feature associated with said outwardly directed extremity, c) a second jaw block associated with the head extremity of said second lever and elongated between forward and rear extremities, and a second interior passage extending between said extremities, said forward extremity facing the inwardly directed extremity of said first jaw block, d) a compliant inelastic cap-engaging strap having a fixed extremity secured by said anchoring feature and an adjustable extremity adapted to travel longitudinally within said second interior passage, said strap forming a loop of adjustable size disposed forwardly of said jaw blocks, and e) a flanged spool upon which said strap is spirally wound, said spool associated with the rear extremity of said second jaw block and adapted to permit motion of said strap through said second passage in the direction of said rear extremity, thereby controlling the size of said loop, f) a ratchet wheel associated with one flange, and a releasable pawl positioned to engage said ratchet wheel, g) a knob associated with said spool in a manner to turn said spool in one direction to wind said strap upon said spool, thereby shortening said loop, and h) tensioning tips associated with said jaw blocks and configured to abut against said strap, whereby i) when the size of the loop is adjusted to make a close fit upon a particular cap, the lever handle extremities may be manually drawn together to cause said strap to tightly embrace said cap, and rotational force may be manually exerted upon the handle extremities, thereby loosening or tightening said cap.

* * * * *